US005237836A

United States Patent [19]

Byrne, deceased et al.

[11] Patent Number: 5,237,836

[45] Date of Patent: Aug. 24, 1993

[54] FIBER MAT CRYOGENIC COOLING

[75] Inventors: Michael D. Byrne, deceased, late of Tolland, by M. Gail Bryne, legal representative; Thomas A. Griswold, Ellington, both of Conn.

[73] Assignee: Brymill Corporation, Vernon, Conn.

[21] Appl. No.: 923,670

[22] Filed: Aug. 3, 1992

[51] Int. Cl.[5] ..... F25D 3/12

[52] U.S. Cl. ..... 62/385; 62/316; 165/104.21; 361/699

[58] Field of Search ..... 62/530, 259, 315, 316, 62/64, 86, 89, 121, 373, 384, 385, 304; 165/104.21; 361/385, 382

[56] References Cited

U.S. PATENT DOCUMENTS

| | | | |
|---|---|---|---|
| Re. 33,567 | 4/1991 | Killip et al. | 73/863.11 |
| 1,986,993 | 1/1935 | Wooll | 62/384 |
| 2,030,005 | 2/1936 | Kellogg | 62/385 |
| 2,766,597 | 10/1956 | Gieck | 62/315 |
| 3,367,136 | 2/1968 | Bottani | 62/384 |
| 3,498,071 | 3/1970 | Tremont | 62/530 |
| 3,656,545 | 4/1972 | van Loo | 165/74 |
| 3,865,183 | 2/1975 | Roush | 361/385 |
| 3,922,878 | 12/1975 | Jalali | 62/384 |

*Primary Examiner*—Albert J. Makay
*Assistant Examiner*—Wiliam C. Doerrler
*Attorney, Agent, or Firm*—M. P. Williams

[57] ABSTRACT

Liquified cryogen, such as nitrogen, from a source (43) is applied to a fiber mat (16, 18) adjacent to surfaces (10, 12) of an article (14) to be cooled. The cryogen may be delivered by a tube (40) which is disposed between the mat and a structure (20) to which the mat is fastened by press fit barbed fasteners (22).

19 Claims, 1 Drawing Sheet

FIBER MAT CRYOGENIC COOLING

TECHNICAL FIELD

This invention relates to cryogenic cooling of articles utilizing a fiber mat to distribute, disperse and contain liquified cryogen, such as nitrogen.

BACKGROUND ART

Until recently, the use of chlorofluorocarbons to cool electronic circuitry was universal. However, concern over the hole in the ozone layer has directed attention to substituting other techniques for anything involving CFCs.

In a commonly owned co-pending U.S. patent application Ser. No. 07/835,117 filed on Feb. 14, 1992, there is disclosed the use of direct liquid nitrogen spray as a substitute for liquid CFC spray for testing circuitry. Therein, there is a complete discussion of the environmental and human compatibility of nitrogen vs. that of CFCs, and the effectiveness of liquid nitrogen in removing heat from circuitry.

The nitrogen spray is extremely useful for rapidly cooling specific circuit elements, or small portions of circuitry, but is less effective in trying to cool entire assemblies (which may range from anywhere around 30 cubic inches (about 500 cubic centimeters) to about 300 cubic inches or more (about 5,000 cubic centimeters or more). As described in the aforementioned co-pending application, the most effective manner of cooling is contacting liquid cryogen directly on the surface of the object to be cooled, whereby the heat of vaporization of the cryogen will extract significant heat from the article being cooled as the nitrogen gasifies.

DISCLOSURE OF INVENTION

Objects of the invention include cooling of large surfaces and relatively large objects in a relatively short period of time, in an inexpensive and safe manner which does not rely on CFCs.

According to the present invention, liquified cryogen, such as nitrogen, having a significant fraction in the liquid phase is dispensed into a fiber mat which is adjacent to a surface from which heat is to be extracted.

According further to the invention, a delivery conduit, such as a tube having a plurality of holes, each of which will deliver liquified cryogen, is disposed adjacent to a fiber mat into which the cryogen will flow from the conduit; the conduit and the mat may be disposed on a cover assembly. In still further accord with the present invention, the mat is held to a plastic cover plate by means of barbed tacks (or nails) driven into blind holes. In one embodiment, the cover assembly is sized to just fit over and encompass one or more surfaces of an object (such as an assembly of circuitry) to be cooled by the nitrogen.

The invention permits pooling of substantial liquid nitrogen directly on a surface of an object to be cooled by the liquified nitrogen. The fiber mat helps both to distribute the liquid nitrogen and to contain it so that it remains more completely in contact with the surface to be cooled prior to vaporization. The invention has the further advantage of being able to receive nitrogen with a significant fraction in the liquid phase from cryogenic distribution units which are readily available in the marketplace.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
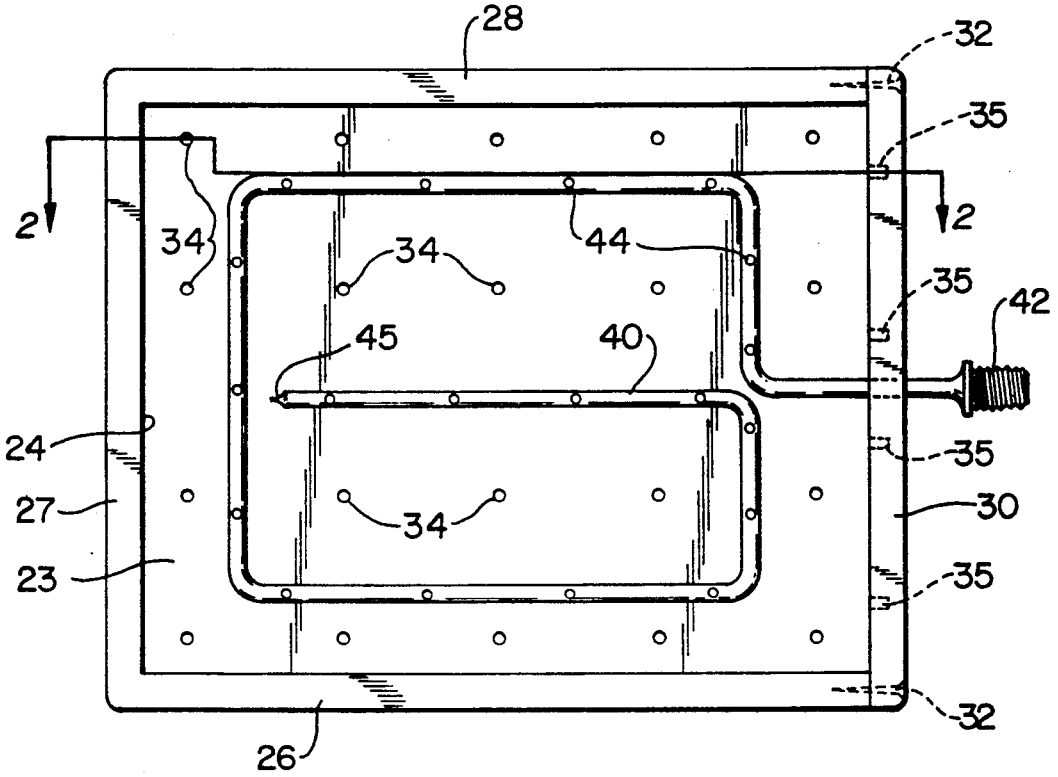
FIG. 1 is a bottom plan view (from the perspective of the surface to be chilled) of an exemplary embodiment of apparatus employing the invention, without the fiber mat in place.

Referring to the drawing, a pair of surfaces 10, 12 of an article such as an assembly 14 to be cooled by liquified nitrogen in accordance with the present invention, are contacted by sections of fiber mat 16, 18 which are held against a structure such as a cover assembly 20 by means of barbed fasteners 22. The cover assembly 20 may consist of a main piece 23 which has a cavity 24 milled therein to provide three short sidewalls 26–28 surrounding the cavity 24. Another sidewall 30 is provided in any suitable fashion, such as by providing a separate piece of suitable thickness and fastening it to the main piece 23 in any suitable way, such as with screws 32. The fit between the pieces 24, 30 should be neat, but it need not be hermetic. The thickness of the main piece 23, the walls 26–28 and the end piece 30 may be on the order of 3/16 inch (about 5 millimeters). Many embodiments will not have any substantial vertical sidewall 30 and will simply provide cooling to the single surface 10; in such a case, the cavity 24 may have four walls, instead of only the three walls 26–28. The cavity 24 may be about 4/10 inch (about 10 millimeters) deep for use with a fiber mat 16 which is on the order of ¼ inch (about 6.4 millimeters) thickness.

Figure 3:
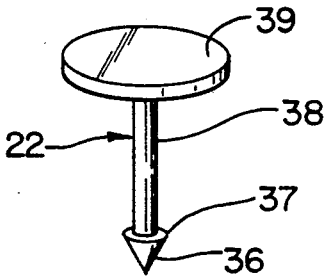
FIG. 3 is a perspective view of a barbed fastener which may be used in implementing the invention.

In preferred embodiments, the main piece 23 and end piece 30 may be formed of delrin, to which literally nothing can be glued, particularly when it is to be used at cryogenic temperatures. Each of the fasteners 22 is driven into a press fit, blind end hole 34, 35 the depth of which is just slightly smaller than the thickness of the cover assembly 20. The fasteners 22 each comprise a tack-like structure (FIG. 3), similar to a steeple head rivet, having a conical end 36, the great diameter 37 of which is just slightly larger than the shank 38 of the fastener. The fastener 22 has a tack-like head which may be on the order of 3/16 inch diameter (about 5 millimeters). The diameter of the shank 38 of the fasteners 22 may be on the order of 90 mils (about 2.3 millimeters), and the great diameter 37 may be about 100 mils (about 2.6 millimeters). The holes 34, 35 may be on the order of 94 mils (about 2.4 millimeters) so that the barb action of the great diameter 37 will cause a very strong resistance to removal once a fastener 22 has been tapped into one of the holes 34, 35. Use of a non-screw fastener has two important advantages: first, a clearance hole is not required in the fiber pad 16, but rather simply a punch hole will suffice. Additionally, since the fastener 22 is simply driven straight in, it does not entangle with the fibers of the mat 16, as a screw might. The mats 16, 18 may not be in intimate contact with some small areas of the surfaces 10, 12, such as adjacent the fasteners 22; of course, a surface which is less than an entire surface 10, 12 could be cooled, if desired.

Figure 2:
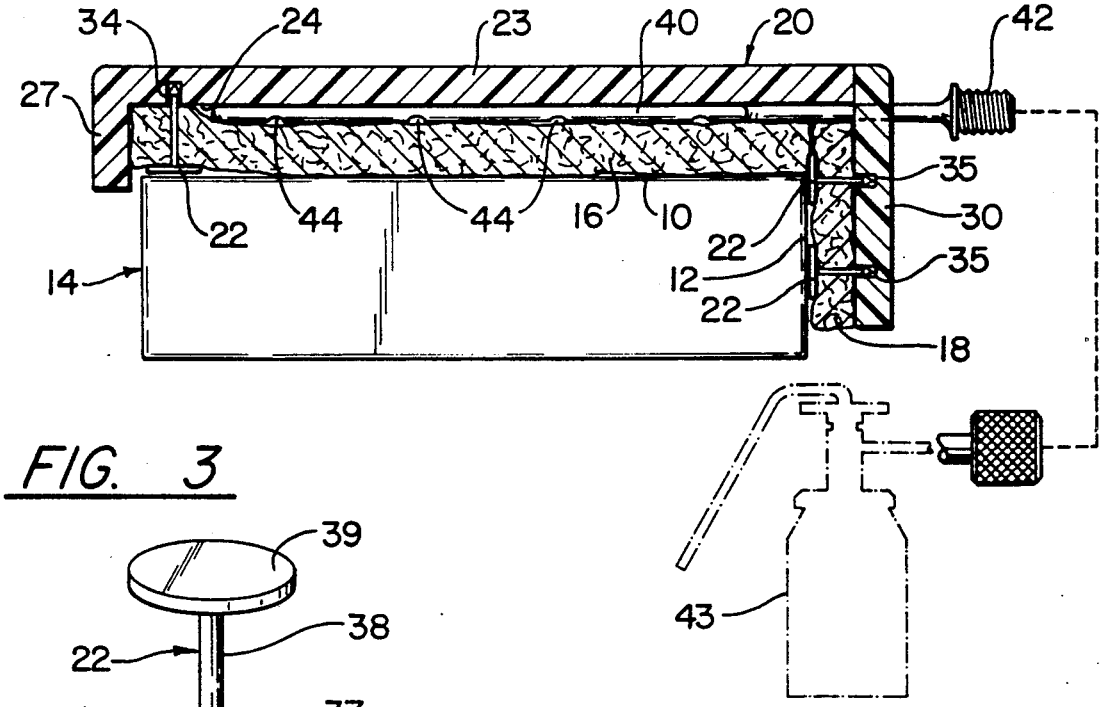
FIG. 2 is a sectioned, side elevation view taken on the line 2—2 of FIG. 1, with the fiber mat in place, in an embodiment of the invention in which a cover assembly is disposed on a unit having a pair of surfaces to be chilled thereby.

When the mat 16 is held in place by the fasteners 22 within the holes 34 it will support a cryogenic delivery conduit, such as a tube 40 which has a threaded distal end 42 thereon to permit fastening to a cryogenic delivery system 43 which may be of the type illustrated in either one of U.S. Pat. Nos. 4,116,199 or 4,269,390. The tube may be ⅛ inch outside diameter (about 3.2 millimeters) thin wall (about 12 mil or 3/10 of a millimeter), 304 stainless steel tubing. The portion of the tube 40 within the cavity 24 is arranged in a square figure eight. In the embodiment herein, that portion of the tube has a plurality of 40 mil (about 1 millimeter) holes spaced apart by about one inch (about 2½ centimeters). The holes are disposed to deliver the nitrogen downwardly as seen in FIG. 2, directly into the fiber mat 16. The proximal end 45 of the tube 40 is pinched shut and welded.

The fiber mat may preferably comprise ¼ inch (6.4 mm) orthopedic felt, which may be 70% wool and 30% rayon polyester. However, a variety of natural fibers, which do not become excessively brittle at cryogenic temperatures, may also be used to advantage in a felt structure so as to form the fiber mats 16, 18. Most felts will be suitable, particularly hair (and blends of hair) felts, such as wool, beaver, rabbit, other furs and the like. The cover structure 20 may be made of other material such as metal, but a plastic which is sturdy at cryogenic temperatures, such as delrin, is preferred since it will contribute less heat to the liquid cryogen (have less heat extracted from it) thereby maximizing the benefit of the cryogen in cooling the assembly 14. The size of typical units may be about 5 inches across (left to right as seen in FIG. 1) and anywhere from 4 to 20 inches long (top to bottom as seen in FIG. 1).

The aforementioned nitrogen delivery units deliver liquid nitrogen in a flow having a significant fraction in the liquid phase, such as on the order of 30% to 90%, by molecular weight, which increases as the delivery system cools down when in use. This is desirable, so as to have significant cooling from the heat of vaporization. One of the nitrogen delivery units described in the aforementioned patents is capable of cooling an area on the order of 80 square inches e.g., somewhat more than 10 inches by 6 inches with a suitably larger conduit (tube 40); for an area as large as 10×20 inches, two such units may feed two separate sets of tubes 40 for proper delivery of an adequate amount of liquid cryogen. On the other hand, if other cryogen delivery units are available, it is possible to cool literally any surface with a single suitably sized cryogenic delivery unit of various types. Those cryogenic delivery units operate at about 10 psi (about 7 grams per square centimeter). If larger diameter delivery tubes and larger holes are used, then it would be possible to supply adequate liquid at a lower pressure; similarly, if a supply operating at a higher pressure were available, then perhaps smaller tubing could be used, although there is no need therefor. If lower cooling rates are acceptable, more area per delivery capacity may be cooled.

The embodiment shown herein has one sidewall 30 which extends downwardly to cool the surface 12 of the assembly 14. The liquid which is fed through the tube 40, flows out the holes 44, is distributed by the mat 16, and eventually reaches the mat 18 and is distributed along the surface 12 thereby. While it is not known for sure, it is believed that the mats 16, 18 provide a sort of wicking action that enhances the uniform distribution (dispersion) of the liquid nitrogen on the surfaces 10, 12, and it is believed that the mats 16, 18 tend to hold the liquid in contact with the surfaces 10, 12, thereby creating a better thermal exchange between the liquid cryogen and the surfaces 10, 12. The mats 16, 18 can be all part the same piece of matting.

Other embodiments may include more sidewalls like the sidewall 30. In fact, there is no reason why all four sidewalls of the assembly 14 should not be

24 formed in the main piece 22 and by the end wall 30 is chosen to be a clearance fit to the principal surface of the assembly 14. When adequate cooling is occurring, there will be gaseous nitrogen visibly escaping all the way around the perimeter of the assembly 14, and in fact, liquid will be flowing down the sidewalls of the assembly 14 in some instances. In the case (as seen in FIG. 2) where there is a mat 18 against a vertical wall of the assembly 14, then liquid clearly flows out through the bottom of the mat 18 once the rate of cooling has stabilized. For usual electronic assemblies, application of liquid nitrogen for about 2–6 minutes will result in component temperatures on the order of −30° F. to −65° F. Of course, the time of application, the temperature reached, the amount of nitrogen and flow rate required, all are dependent on the material, mass, and other characteristics of the subject being chilled.

The invention may be practiced, in certain cases, such as where an irregular surface of an assembly 14 is to be chilled, by simply conforming a fiber mat 16 adjacent to the surface, and gently pouring liquid nitrogen onto the mat in a somewhat uniform fashion. Or, the cover assembly 20 may be shaped to conform to assemblies 14 of a variety of shapes. Even though gravity aids the liquid nitrogen to pool on the surfaces 10, 12 of the assembly 14, the bottom of the assembly 14 may also be fitted with a mat 16 held in place with an additional cover piece; and either fed nitrogen through an additional delivery tube, or not. In fact, the assembly 14 may be surrounded by mats saturated with liquid nitrogen, so long as suitable venting is provided. All of this depends on the nature of the assembly 14 and the cooling of it which is desired. Although other cryogens having a boiling point below −100° F. may be used as a cryogen in this invention, nitrogen is clearly preferred because of the environmental, economic and availability advantages thereof.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. Extracting heat from an article by delivering liquid cryogen having a boiling point below −100° F. into a fiber mat in contact with a surface of said article.

2. The method of claim 1 in which liquid nitrogen is delivered in a flow having a significant fraction of nitrogen in its liquid phase.

3. The method of claim 1 in which liquid nitrogen is delivered into a felt mat.

4. Extracting heat from a surface by disposing a fiber mat into substantially intimate contact with said surface and delivering liquid nitrogen from a source of liquified nitrogen into said fiber mat.

5. The method of claim 4 in which liquid nitrogen is delivered in a flow having a significant fraction of nitrogen in its liquid phase.

6. The method of claim 4 in which said fiber mat is at least 60% natural fiber.

7. The method of claim 4 in which a felt mat is used.

8. The method of claim 4 in which a hair felt mat is used.

9. The method of claim 4 in which a mat of orthopedic felt is used.

10. The method of claim 4 in which a mat of about 70% wool and about 30% rayon polyester is used.

11. Apparatus for cryogenic cooling of an article comprising:

a fiber mat adapted to be disposed when in use in proximity with a surface of the article to be cooled;

a cryogen delivery conduit disposed adjacent to said fiber mat, adapted for connection with a source of liquified cryogen when said apparatus is in use, and providing, when said apparatus is in use, liquid cryogen from said source to a substantial portion of said fiber mat that is adjacent to said surface of said article to be cooled.

12. Apparatus according to claim 11 wherein said mat, when in use extends beyond proximity with and at an angle to said first named surface and is adapted to be disposed on a second surface of said article to be cooled when in use.

13. Apparatus according to claim 11 wherein said conduit is a tube having holes therein on the side thereof adjacent to said mat for distributing cryogen therethrough to said mat, and having a fitting on an end thereof remote from said mat for releasably engaging a source of liquified cryogen.

14. Apparatus according to claim 11 further comprising:

a structure disposed on a side of said delivery conduit opposite to the side thereof adjacent to said mat, such that said delivery conduit is sandwiched between said structure and said mat.

15. Apparatus according to claim 14 wherein said structure includes a main piece adapted to be disposed, when said apparatus is in use, adjacent said first named surface and a second piece connected thereto and adapted to be disposed, when said apparatus is in use, adjacent to another surface of the article to be cooled; and including a fiber mat disposed adjacent said second piece.

16. Apparatus according to claim 14 wherein said mat is fastened to said structure.

17. Apparatus according to claim 14 wherein said mat is fastened to said structure by barbed, tack-like fasteners press fit into corresponding holes within said structure.

18. Apparatus according to claim 17 wherein said fasteners each have a shank with a tack-like head on one end and a cone head, the great diameter of which is on the order of 10 mils (0.3 millimeters) larger than the diameter of said shank, on the other end.

19. Apparatus according to claim 17 wherein said fasteners are shaped like steeple-head rivets.

* * * * *